United States Patent [19]

Cochran et al.

[11] Patent Number: 4,726,922

[45] Date of Patent: Feb. 23, 1988

[54] YARN DRYING PROCESS

[75] Inventors: Stanley R. Cochran, Midlothian; Hung H. Yang, Richmond, both of Va.

[73] Assignee: E. I. Du Pont de Nemours and Company, Wilmington, Del.

[21] Appl. No.: 941,501

[22] Filed: Dec. 12, 1986

Related U.S. Application Data

[63] Continuation of Ser. No. 719,819, Apr. 4, 1985, abandoned, which is a continuation-in-part of Ser. No. 558,310, Dec. 5, 1983, abandoned, which is a continuation-in-part of Ser. No. 487,898, Apr. 22, 1983, abandoned.

[51] Int. Cl.[4] ..... D01F 6/26

[52] U.S. Cl. ..... 264/184

[58] Field of Search ..... 264/184, 289.3

[56] References Cited

U.S. PATENT DOCUMENTS 3,817,941 6/1974 Bair et al. .

3,869,429 3/1975 Blades ..... 264/184

FOREIGN PATENT DOCUMENTS 98415 8/1978 Japan .

*Primary Examiner*—James Lowe

[57] ABSTRACT

Aromatic polyamide filaments of higher strength are obtained by drying air-gap spun filaments under tension while controlling the moisture content of the dried filaments.

7 Claims, No Drawings

YARN DRYING PROCESS

CROSS-REFERENCE TO RELATED APPLICATIONS

This application is a continuation of abandoned application Ser. No. 719,819, filed Apr. 4, 1985, which is a continuation-in-part of abandoned application Ser. No. 558,310 filed Dec. 5, 1983, which was therefor a continuation-in-part of abandoned application Ser. No. 487,898 filed Apr. 22, 1983.

TECHNICAL FIELD

This invention relates to an improved drying process for filaments of aromatic polyamides whose chain extending bonds are coaxial or parallel and oppositely directed. Such filaments are hereinafter referred to as para-aramid filaments.

BACKGROUND ART

U.S. Pat. No. 3,767,756 describes a process for spinning para-aramids to provide filaments having excellent as-spun tenacity, modulus and breaking elongation. In practice, sulfuric acid having a concentration of at least 98% is used as the spinning solvent. Due to the degrading effects of even small amounts of acid in the yarn, complete removal of the acid is very important in obtaining high tenacity fibers. Water alone or combinations of alkaline solutions and water have been used for its removal. The sulfuric acid is partly removed from the spinning threadline in a coagulation bath whereby most of the sulfuric acid is removed. As disclosed in U.S. Pat. No. 4,048,279, the acid containing yarn is further washed first with a 0.3 to 1.3% aqueous caustic solution and then with a more dilute aqueous caustic solution having a concentration of 0.01 to 0.1%.

The para-aramid filaments obtained by the above-described spinning and washing processes have excellent properties but even further improvement in tenacity and modulus is desired. From U.S. Pat. No. 3,869,429 it is known that drying the filaments obtained using such processes under tensions above 0.3 gpd reduces the breaking elongation of the filaments while increasing the modulus. Drying under tension is also disclosed in U.S. Pat. No. 3,869,430, Example IIe. No effect of drying tension on the tenacity of the filaments or yarns thereof has been reported.

Japanese Application Publication Kokai 53-98415, published Aug. 28, 1978, owned by Asahi Chemical Industry Co., Ltd., also describes the increase in modulus resulting when para-aramid yarns are dried under tension to low moisture contents. With only one exception, all the examples show drying to less than 4 percent by weight water. The single exception is its Practical Example 4 to a moisture content of 5.1%. Their stated goal is to "substantially increase modulus without causing heat deterioration, while maintaining intrinsic viscosity and tensile strength . . . ".

In typical washing and drying processes using yarn tensions of less than 1 gpd, the amount of moisture remaining on the yarn after drying has been shown to have little effect on the yarn tenacity.

BRIEF DESCRIPTION OF THE INVENTION

This invention provides an improved process for drying high strength, high modulus filaments of aromatic polyamides having an inherent viscosity of at least 4.0 whose chain extending bonds are coaxial or parallel and oppositely directed by the steps of extruding an anisotropic solution of the polyamide in 98.0 to 100.2% sulfuric acid having a polyamide concentration of at least 30 g/100 ml sulfuric acid through a layer of non-coagulating fluid into a coagulating bath and then washing and drying the filaments whereby the tenacity of yarns comprised of the filaments is increased by washing the filaments under a tension of at least one-third of the tension on the filaments during drying and then drying the filaments at a temperature of less than 300° C. under a tension of at least 2 gpd and thereafter discontinuing the drying under tension while the filaments on heated rolls have a moisture content of at least 8%. Preferably the filaments are dried at a temperature of no more than 175° C., the tension on the filaments during drying is 3 to 7 gpd and the dried filaments contain at least 10% moisture. The preferred aromatic polyamide is poly(p-phenylene terephthalamide). Optionally, the dried filaments may be heat treated at a temperature of 300°-600° C. under a tension of at least 0.5 gpd. Such heat treated filaments have improved tenacity over similar filaments dried under low tension and heat treated under the same conditions.

DETAILED DESCRIPTION OF THE INVENTION

Usual processes for spinning high strength high modulus aromatic polyamide filaments from aromatic polyamides employ filament tensions of no higher than 1 gpd, usually 0.3 to 0.9 gpd, in the washing and drying steps. When such low tensions are used, the moisture content of the dried filaments has little effect on the tenacity of the filaments.

In the process of the present invention, application of moderate to high tension on the filaments during drying provides a tenacity improvement of at least 0.5 gpd as well as the expected higher modulus, provided the filaments are not dried too severely. Increased tension in washing and/or neutralization advantageously decreases the tension required in drying to obtain the same improvement in tenacity. Increased moisture levels in the dried filaments may result from shorter exposure times to the heated rolls or by using lower drying roll temperatures. Preferably the higher moisture content of the dried filaments results from using low drying roll temperatures. While increased tenacities also result at moisture contents of 20% and greater, contents above 15% should be avoided to ensure stability of yarn packages during storage.

The minimum moisture content of at least 8% by weight, and preferably at least 10%, at the completion of drying under tension is greater than the equilibrium moisture content at normal ambient atmospheric conditions. Subsequent loss of moisture on storage under mild conditions, e.g., at normal ambient atmospheric conditions, does not result in loss of the tenacity increases obtained by drying to the higher moisture contents.

Optimum drying tension will depend on the overall conditions used.

Tension on the filaments is preferably maintained by suitable control of the surface speed of rolls used to forward the filaments. Other means of maintaining tension may also be used, as desired.

Drying rolls may be heated by any means and are preferably at least partially enclosed to prevent excessive loss of heat. Drying rolls heated with saturated steam are particularly useful. After drying, the filaments may be packaged in any desired way such as, for example, winding the filaments on a bobbin. A finish or water may conveniently be applied to the filaments before packaging.

TESTS

Linear Density

This is the weight in grams of a standard length of filament or yarn. Throughout this work, the primary determination of linear density was denier (D), i.e., the weight in grams of 9000 meters. Linear density in dtex is the weight in grams of 10,000 meters. Thus, $$dtex = 1.111\ (D)$$

Unless otherwise indicated, all linear densities reported herein are based on "bone dry" weights, i.e., the weight of untwisted yarn after drying at 135° to 140° C. in an oven for 30 minutes. Yarns so dried always retain some moisture. Bone-dry linear densities can be converted to linear densities at the conditions of equilibration before tensile testing simply by multiplication by 1.04. While the absolute value of this factor depends a bit on previous yarn history, 1.04 is a very close approximation for the yarns of this invention.

Moisture on Yarn

While the determination is useful at any stage, it is ordinarily used for yarn immediately as received from a drying step so as to measure effectiveness of the drying. Yarn as dried is wound without finish onto a bobbin with enough traverse strokes for four or more yarn layers. On doffing the bobbin its surface layer is immediately stripped off, a sample long enough to weigh at least 0.5 g is then removed and placed immediately inside a polyethylene bag which is sealed with tape. Weight of bag, tape, and sample is recorded as $W_1$. The sample is placed in an aluminum cup and heated in an oven at 135° to 140° C. for 30 minutes. Meanwhile, weight of bag and tape is recorded as $W_2$ so that $W_1-W_2$ becomes the weight of the moist sample. The hot sample in its aluminum cup, on removal from the oven, is immediately placed in a nitrogen-blanketed desiccator and cooled 5 minutes. Then the yarn sample alone is weighed to obtain $W_3$. The percent moisture on (or in) yarn (% MOY) as originally collected is calculated from:

$$\%\ MOY = 100 \times \frac{(W_1 - W_2) - W_3}{W_3}$$

Tensile Testing

Tenacity, elongation, and modulus are all obtained from data read from a plot of stress vs. strain generated by a typical laboratory stress-strain tester. The yarn is conditioned first for 14 hours in the same atmosphere in which the tester is located, i.e., 55% relative humidity and 75° F. (23.9° C.). Also, before testing, the yarn is hand twisted to a twist multiplier of 1.1. Sample length is 10 in (25.4 cm), strain rate is 1.0 in/min (2.54 cm/min), and chart speed of the recorder is 10 in/min (25.4 cm/min). Tenacity (T) is computed from the breaking stress (grams) by dividing by "bone dry" denier. Elongation (E) is the precentage increase in length at break. Modulus (M) is computed from the initial straight line slope of the stress-strain plot, i.e., $$M = \left(\frac{\Delta S}{\Delta L}\right)\left(\frac{L}{D}\right)$$

where

ΔS is incremental stress change in grams
ΔL is incremental change in length
ΔL is initial length in same units as ΔL
D is denier (bone dry).

Both T and M values thus obtained can be converted to those based on equilibrated deniers by division by 1.04. Multiplication of tenacity or modulus in g/den by 0.8838 converts to dN/tex. Toughness is the area under the stress-strain curve.

Inherent Viscosity

Inherent viscosity (I.V.) is defined by $$I.V. = \frac{\ln \eta_{rel}}{C}$$

where $\eta_{rel}$ *is the solution/solvent ratio of flow times in a capillary viscometer at* 30° C. when the solvent is 96% sulfuric acid and C is the solution concentration of 0.5 g/dL.

EXAMPLE 1

This example illustrates the effect of drying tension on yarn tenacity. A spin dope was prepared from poly(p-phenylene terephthalamide) (I.V.=5.59) and 100.1% $H_2SO_4$ to provide an anisotropic dope containing 19.55% by weight polymer. The deaerated spin dope was extruded at 80° C. through a spinneret having 768 holes, each with a diameter of 0.0635 mm. Length of the air-gap was 6.4 mm, and the coagulating bath (5° C.) was water containing 4% by weight sulfuric acid. The quenching device was as described in Yang U.S. Pat. No. 4,340,559 with a jet device as in its claim 4. Yarn was withdrawn from the quenching device at about 400 ypm (365.8 m/min) and washed and neutralized on two sets of rolls with water spray on the first and dilute caustic spray on the second. Yarn tensions were 0.9 gpd (0.8 dN/tex) during washing and 0.8 gpd (0.7 dN/tex) during neutralization, and saturated steam at 147.5° C. was used to internally heat the pair of rolls. Before windup, a finish was applied to the yarn. This example shows the increase in tenacity with increasing tension on drying as modified by the moisture content of the dried yarn. The results are summarized in Table I. In Table I, 1-B represents an example of the drying tension of the present invention and 1-A represents a comparison with low drying tension.

TABLE I

| Sample | 1-A | 1-B |
|---|---|---|
| Drying tension, gpd | 0.5 | 3.2 |
| (dN/tex) | (0.4) | (2.8) |
| Moisture on Yarn, % | 11.5 | 11.0 |
| Denier | 1165 | 1111 |
| (dtex) | (1294) | (1234) |
| Tenacity, gpd | 25.2 | 27.3 |
| (dN/tex) | (22.3) | (24.1) |
| Elongation, % | 3.54 | 3.1 |
| Modulus, gpd | 629 | 799 |
| (dN/tex) | (556) | (706) |
| Toughness, gpd | 0.45 | 0.42 |
| (dN/tex) | (0.40) | (0.37) |

EXAMPLE 2

This example illustrates the effect of moisture content of just-dried yarn on tenacity obtained. Two tests (2-D and 2-E) were run at both low tensions and low residual moisture, and they yielded the lowest tenacities. Yarns were prepared substantially as described in Example 1. However, tensions during washing, neutralization and drying, and saturated steam temperatures for the drying rolls were as shown in Table II. In Table II, 2-A and 2-F represent examples of the invention. Runs 2-D and 2-E represent comparisons with low drying tensions and low residual moisture while runs 2-B, 2-C, and 2-G represent comparisons with low residual moisture. All of the comparison runs exhibit reduced tenacities.

TABLE II

| Sample | 2-A | 2-B | 2-C | 2-D | 2-E | 2-F | 2-G |
|---|---|---|---|---|---|---|---|
| Tensions | | | | | | | |
| Washing, gpd | 1.74 | 1.74 | 1.75 | 0.87 | 0.87 | 1.75 | 1.75 |
| (dN/tex) | (1.54) | (1.53) | (1.55) | (0.77) | (0.77) | (1.55) | (1.55) |
| Neutralization, gpd | 1.74 | 1.74 | 1.75 | 0.87 | 0.87 | 1.75 | 1.75 |
| (dN/tex) | (1.54) | (1.53) | (1.55) | (0.77) | (0.77) | (1.55) | (1.55) |
| Drying, gpd | 5.23 | 5.21 | 5.24 | 0.87 | 0.87 | 5.24 | 5.24 |
| (dN/tex) | (4.62) | (4.60) | (4.64) | (0.77) | (0.77) | (4.64) | (4.64) |
| Drying Temperature, °C. | 135 | 167 | 178 | 178 | 167 | 121 | 167 |
| Moisture on Yarn, % | 9.75 | 4.5 | 4.08 | 3.50 | 5.11 | 23.62 | 5.01 |
| Yarn I.V. | 5.25 | 5.42 | 5.12 | 5.17 | — | 5.27 | 5.33 |
| Denier | 1148 | 1152 | 1144 | 1151 | 1152 | 1146 | 1143 |
| (dtex) | (1276) | (1280) | (1271) | (1279) | (1280) | (1273) | (1270) |
| Tenacity, gpd | 27.4 | 26.2 | 25.6 | 23.4 | 24.2 | 26.9 | 25.2 |
| (dN/tex) | (24.2) | (23.2) | (22.6) | (20.7) | (21.4) | (23.8) | (22.3) |
| Elongation, % | 3.00 | 2.73 | 2.67 | 3.03 | 3.17 | 3.40 | 2.60 |
| Modulus, gpd | 849 | 900 | 888 | 697 | 691 | 681 | 896 |
| (dN/tex) | (750) | (795) | (785) | (616) | (611) | (602) | (792) |
| Toughness, gpd | 0.41 | 0.36 | 0.34 | 0.35 | 0.38 | 0.46 | 0.33 |
| (dN/tex) | (0.37) | (0.32) | (0.31) | (0.32) | (0.35) | (0.41) | (0.29) |

EXAMPLE 3

This example also illustrates the effect of moisture content on yarn tenacity. Yarns were prepared substantially as described in Example 1 except that yarn tensions were 1.8 gpd (1.59 dN/text) during washing and neutralization and 5.5 gpd (4.86 dN/text) during drying, and saturated steam at 160° C. was used for the drying rolls. Results are summarized in Table III. In Table III, 3-A and 3-B represent examples of the present invention and 3-C represents a comparison with low residual moisture.

TABLE III

| Sample | 3-A | 3-B | 3-C |
|---|---|---|---|
| Moisture on Yarn, % | 11.0 | 9.0 | 6.5 |
| Denier | 1100 | 1109 | 1105 |
| (dtex) | (1222) | (1232) | (1228) |
| Tenacity, gpd | 27.8 | 26.4 | 25.5 |
| (dN/tex) | (24.6) | (23.3) | (22.5) |
| Elongation, % | 3.0 | 2.8 | 2.6 |
| Modulus, gpd | 869 | 909 | 912 |
| (dN/tex) | (768) | (803) | (806) |
| Toughness, gpd | 0.42 | 0.37 | 0.33 |
| (dN/tex) | (0.37) | (0.33) | (0.29) |

EXAMPLE 4

This example illustrates very high yarn tenacity achieved by the invention. The yarn was prepared substantially as described in Example 1. However, tensions during washing, neutralization and drying, and saturated steam temperature for the drying rolls were as shown in Table IV.

TABLE IV

| Sample | 4 |
|---|---|
| Tensions | |
| Washing, gpd | 1.8 |
| (dN/tex) | (1.6) |
| Neutralization, gpd | 1.8 |
| (dN/tex) | (1.6) |
| Drying, gpd | 5.3 |
| (dN/tex) | (4.7) |
| Drying Temperature, °C. | 160 |
| Moisture on Yarn, % | 8.5 |
| Denier | 1124 |
| (dtex) | (1249) |
| Tenacity, gpd | 28.1 |
| (dN/tex) | (24.8) |
| Elongation, % | 2.98 |
| Modulus, gpd | 871 |
| (dN/tex) | (760) |
| Toughness, gpd | 0.42 |
| (dN/tex) | (0.37) |

What is claimed is:

1. In a process for drying high strength, high modulus filaments of aromatic polyamides having an inherent viscosity of at least 4.0 whose chain extending bonds are coaxial or parallel and oppositely directed, by the steps of extruding an anisotropic solution of the polyamide in 98.0 to 100.2% sulfuric acid having a polyamide concentration of at least 30 g/100 ml sulfuric acid through a layer of non-coagulating fluid into a coagulating bath and then washing and drying the filaments, the improvement for increasing the tenacity of yarns comprised of the filaments wherein the washing of the filaments is effected under a tension of at least one-third of the tension on the filaments during drying and the drying of the filaments is effected on heated rolls at a temperature of less than 300° C. under a tension of at least 2 gpd and thereafter discontinuing the drying under tension while the filaments have a moisture content of at least 8%.

2. Process of claim 1 wherein the aromatic polyamide is poly(p-phenylene terephthalamide).

3. Process of claim 1 wherein the tension on the filaments during the drying is 3 to 7 gpd.

4. Process of claim 3 wherein the drying is discontinued while the moisture content of the filaments is at least 10% and the drying temperature is less than 175° C.

5. Process of claim 4 wherein the aromatic polyamide is poly(p-phenylene terephthalamide).

6. Process of claim 4 wherein the tension on the filaments during the drying is 5 to 7 gpd.

7. Process of claim 6 wherein the aromatic polyamide is poly(p-phenylene terephthalamide).

* * * * *